US010074941B1

(12) United States Patent
Su et al.

(10) Patent No.: US 10,074,941 B1
(45) Date of Patent: Sep. 11, 2018

(54) HIGH-SPEED CONNECTOR AND CONNECTOR ASSEMBLY

(71) Applicant: NEXTRONICS ENGINEERING CORP., New Taipei (TW)

(72) Inventors: Hou-An Su, Keelung (TW); Hung-Wei Hsu, Taipei (TW); Chang-Fa Yang, Taipei (TW); Xiao-Qiong Liao, Hengyang County (CN); Mei-Jie Zhou, Shantou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 15/867,170

(22) Filed: Jan. 10, 2018

(30) Foreign Application Priority Data

Aug. 22, 2017 (CN) ..... 2017 1 0724325

(51) Int. Cl.

| | |
|---|---|
| ***H01R 13/648*** | (2006.01) |
| ***H01R 13/6585*** | (2011.01) |
| ***H01R 13/6461*** | (2011.01) |
| ***H01R 13/40*** | (2006.01) |
| ***H01R 13/506*** | (2006.01) |

(52) U.S. Cl.
CPC ..... *H01R 13/6585* (2013.01); *H01R 13/40* (2013.01); *H01R 13/506* (2013.01); *H01R 13/6461* (2013.01)

(58) Field of Classification Search
CPC ..... H01R 13/5219; H01R 13/5213; H01R 13/6581; H01R 13/6585; H01R 13/6594; H91R 24/60; H91R 24/64
USPC ..... 439/660, 607.05
See application file for complete search history.

(56) References Cited

U.S. PATENT DOCUMENTS

| | | | | |
|---|---|---|---|---|
| 9,231,356 | B1 * | 1/2016 | Ju | H01R 24/78 |
| 9,966,693 | B2 * | 5/2018 | Liu | H01R 13/5219 |
| 2017/0070013 | A1 * | 3/2017 | Hsu | H01R 24/60 |
| 2017/0214193 | A1 * | 7/2017 | Tsai | H01R 24/64 |

* cited by examiner

*Primary Examiner* — Hien Vu
(74) *Attorney, Agent, or Firm* — Li & Cai Intellectual Property (USA) Office

(57) ABSTRACT

A high-speed connector includes an insulating body, an insulating cap, two terminal sets and two shielding sheets. The insulating body includes a body portion and a tongue plate. The tongue plate divides the interior of the body portion into two accommodating spaces. The insulating cap is fitted around the front end of the tongue plate of the insulating body. Each of the two terminal sets includes a terminal base and a plurality of terminals. The two shielding sheets are disposed on one side of each of the two terminal sets respectively. A plurality of ground ports is disposed on one side of each shielding sheet respectively, in which the plurality of ground ports contacts the plurality of ground terminals of the plurality of terminals of each terminal set so that the two shielding sheets form ground shielding with the ground terminals of each terminal set respectively.

18 Claims, 13 Drawing Sheets

HIGH-SPEED CONNECTOR AND CONNECTOR ASSEMBLY

BACKGROUND OF THE INVENTION

1. Field of the Invention

The present disclosure relates to a high-speed connector and a connector assembly, and more particularly to a connector device that achieves high speed transmission.

2. Description of Related Art

In the field of communication and transmission, as the amount and speed of transmission increase, traditional transmission technology can no longer apply, especially to fields of application such as computer centers, internal core nodal systems, search engines, large scale websites and high performance computers. Centum Form-factor Pluggable (CFP) modules are light emitting and receiving modules according to a standard defined by CFP MSA that is applicable to 40 GE/100 GE, the main features of which are their small size, the ability to output parallel signal in 40 GE and 100 GE, and that they are hot swappable. However, conventional CFP connectors have the disadvantages that the terminals exhibit poor shielding effect, thus having cross talk problems and therefore failing to achieve high-speed transmission.

Accordingly, after intensive research, the applicant herein provides the present disclosure that addresses the above-mentioned problems.

SUMMARY OF THE INVENTION

The main object of the present disclosure is to provide a high-speed connector and a connector assembly, which provide higher shielding capability, thereby achieving crosstalk reduction and high-speed transmission.

In order to achieve the aforementioned objects, one embodiment of the present disclosure provides a high-speed connector including an insulating body, an insulating cap, two terminal sets, and two shielding sheets. The insulating body includes a body portion and a tongue plate. The body portion is hollow. The tongue plate is disposed in the body portion and divides the interior of the body portion into two accommodating spaces, and the front end of the tongue plate protrudes from that of the body portion. The insulating cap includes a receiving hole formed therein, in which the receiving hole extends along a longitudinal direction of the insulating cap. The rear end of the insulating cap has an opening. The insulating cap is fitted around the front end of the tongue plate of the insulating body. The insulating cap has a plurality of terminal grooves on both sides thereof. Each of the two terminal sets includes a terminal base and a plurality of terminals. The plurality of terminals includes a plurality of ground terminals and is disposed on the terminal base. A first end and a second end are respectively formed on either end of each of the plurality of terminals. The two shielding sheets are disposed on one side of each of the two terminal sets respectively. A plurality of ground ports is disposed on one side of each of the two shielding sheets respectively, in which the plurality of ground ports contacts the plurality of ground terminals of the plurality of terminals of each of the terminal sets so that the two shielding sheets form ground shielding with the ground terminals of each of the two terminal sets respectively. The two shielding sheets and the two terminal sets are inserted into the two accommodating spaces of the insulating body respectively such that the first end of the plurality of terminals protrudes from the front end of the body portion of the insulating body and extends into the terminal grooves on both sides, and the second end of the plurality of terminals are exposed at the rear end of the body portion of the insulating body.

To solve the above-mentioned problems, the present disclosure further provides a connector assembly, which includes a high-speed connector and a socket connector. The high-speed connector is a plug connector. The socket connector includes an insulating base, a first socket-terminal set, and a second socket-terminal set. The insulating base includes an insertion groove. A plurality of separators is disposed on two opposite sides of the insertion groove. The plurality of separators are spaced apart, in which the first socket-terminal set includes a first terminal base and a plurality of first socket terminals disposed on the first terminal base, and the second socket-terminal set includes a second terminal base and a plurality of second socket terminals disposed on the second terminal base. The first socket-terminal set and the second socket-terminal set are installed in the insulating base, in which each of the plurality of first socket terminals has a first contact end, and each of the plurality of second socket terminals has a second contact end. The first contact end of each of the first socket terminals and the second contact end of each of the second socket terminals are situated in the insertion groove of the insulating base, in which the first contact end of each of the first socket terminals and the second contact end of each of the second socket terminals form two vertically adjacent rows and are accommodated between the separators. At least some of the separators include a space portion, through which the first contact ends of two adjacent first socket terminals and the second contact ends of two adjacent second socket terminals change the coupling effect, thereby lowering capacitance and increasing the inductance. The front end of the high-speed connector is inserted into the insertion groove of the insulating base of the socket connector in a manner such that the first end of each of the terminals is in electrical connection with the first contact end of each of the first socket terminals and the second contact end of each of the second socket terminals.

The present disclosure is advantageous in that the high-speed connector includes two shielding sheets, each of which is disposed on one side of each of the two terminal sets respectively. A plurality of ground ports is disposed on one side of each of the two shielding sheets, in which the plurality of ground ports contacts the plurality of ground terminals of the plurality of terminals of each of the terminal sets so that the two shielding sheets form ground shielding with the ground terminals of each of the two terminal sets respectively. Therefore, the connector and the connector assembly of the present disclosure provide higher shielding effect, thereby achieving crosstalk reduction and high-speed transmission.

In order to further the understanding of the present disclosure, the following embodiments are provided along with illustrations to facilitate the disclosure of the present disclosure.

DETAILED DESCRIPTION OF THE PREFERRED EMBODIMENTS

Figure 1:
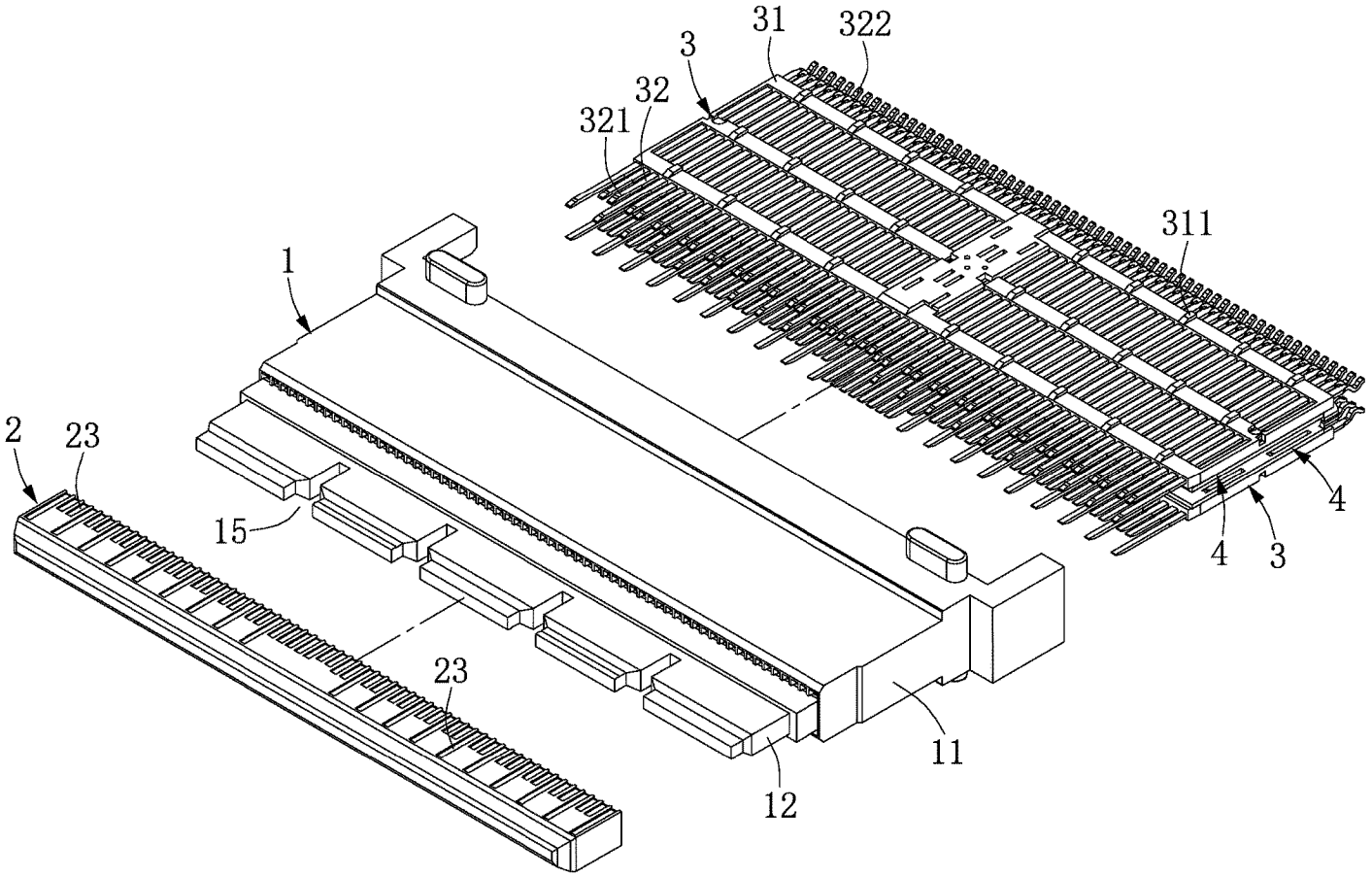
FIG. 1 is a perspective exploded view illustrating a high-speed connector according to a first embodiment of the present disclosure.
Figure 2:
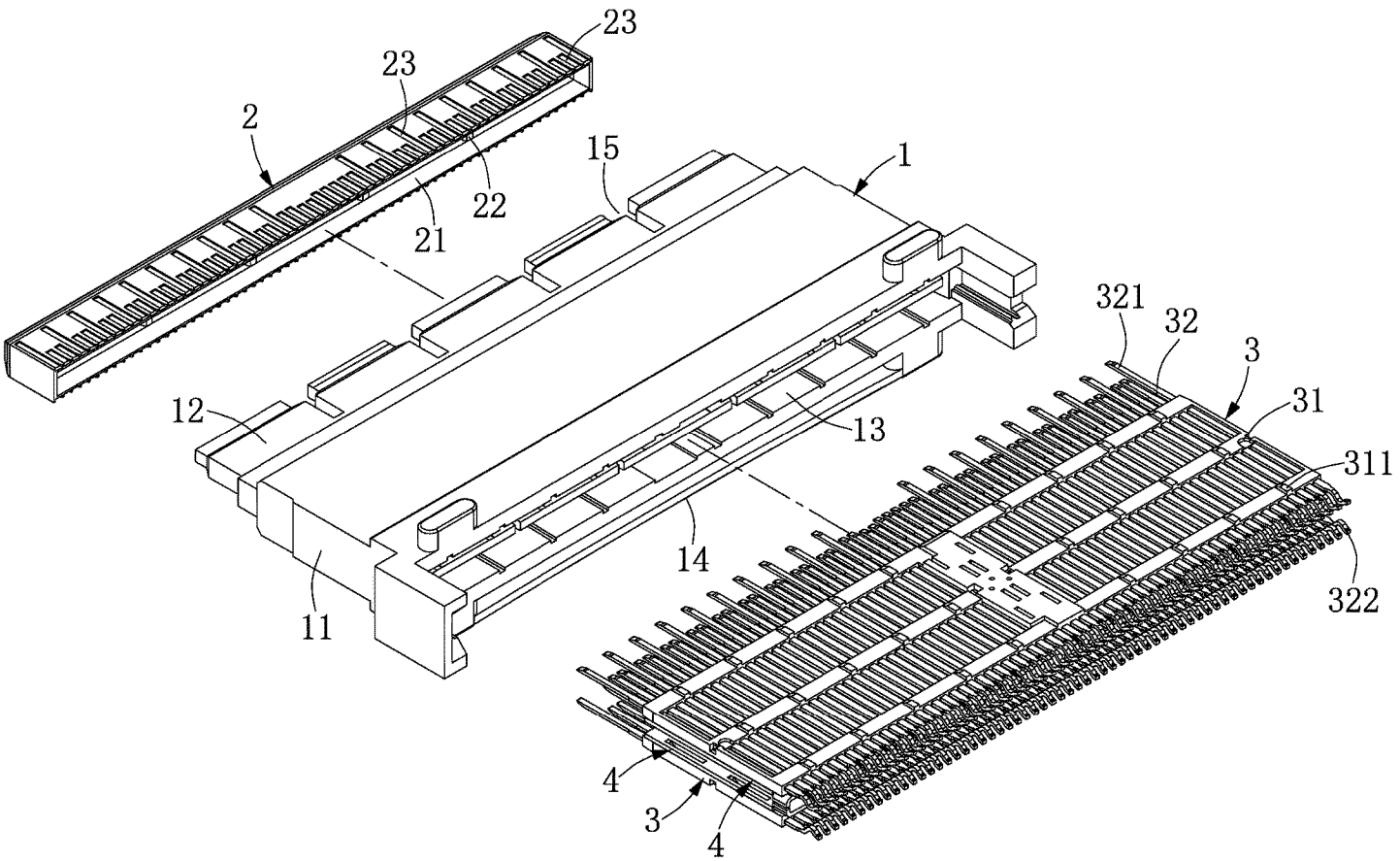
FIG. 2 is a perspective exploded view illustrating the high-speed connector according to the first embodiment of the present disclosure seen from another point of view.
Figure 3:
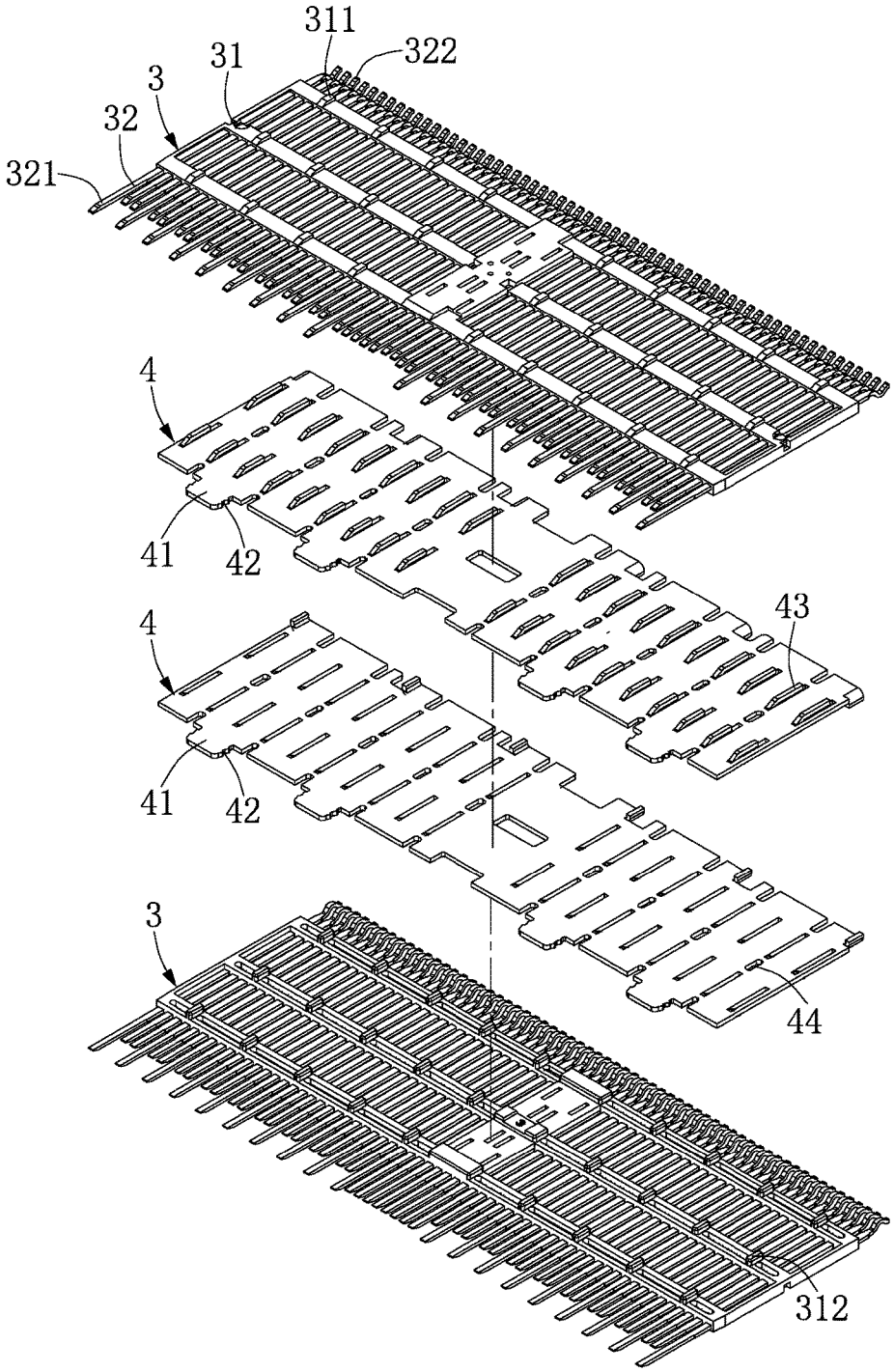
FIG. 3 is a perspective exploded view illustrating a partial structure of the high-speed connector according to the first embodiment of the present disclosure.
Figure 4:
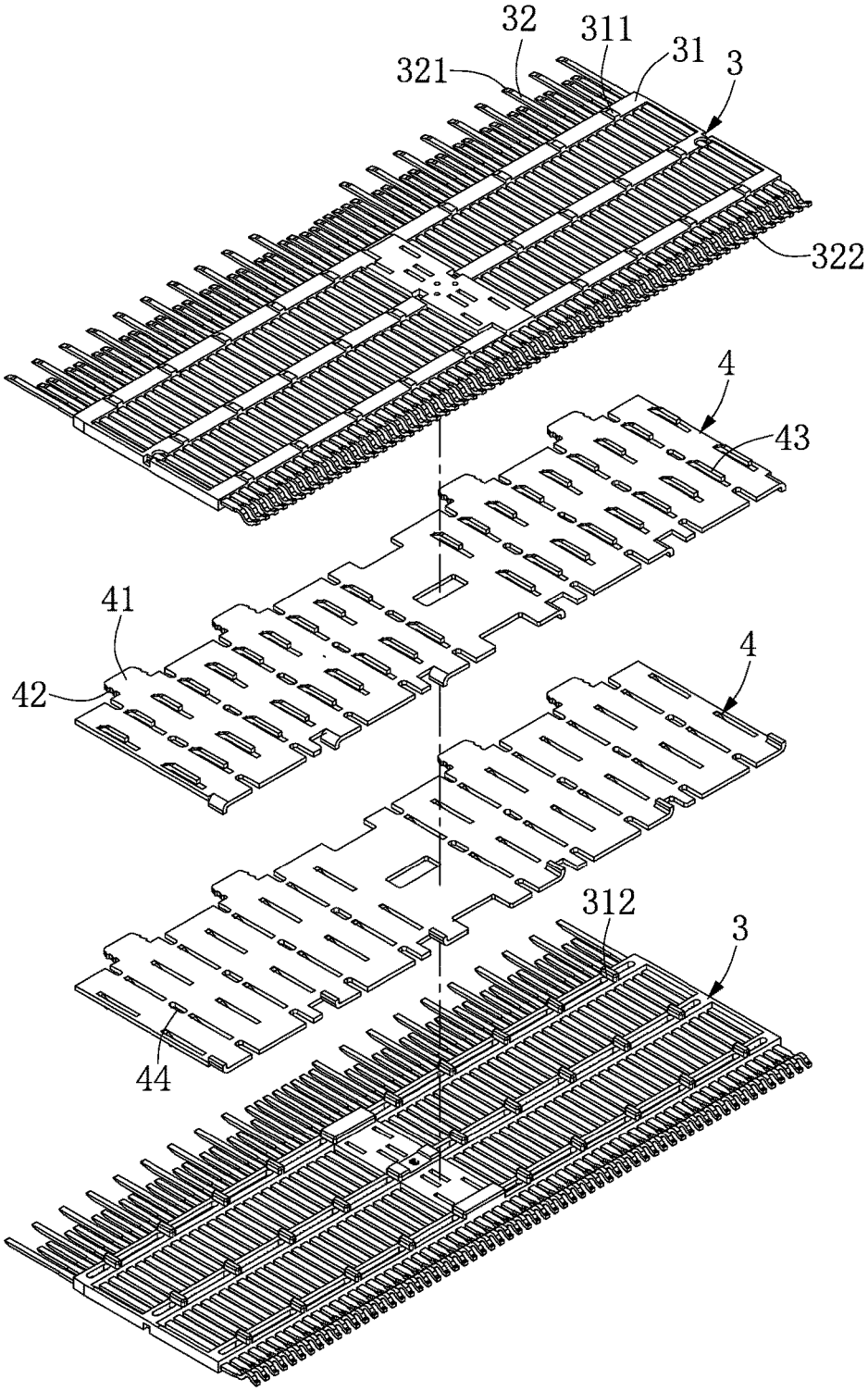
FIG. 4 is a perspective exploded view illustrating the partial structure of the high-speed connector according to the first embodiment of the present disclosure seen from another point of view.
Figure 5:
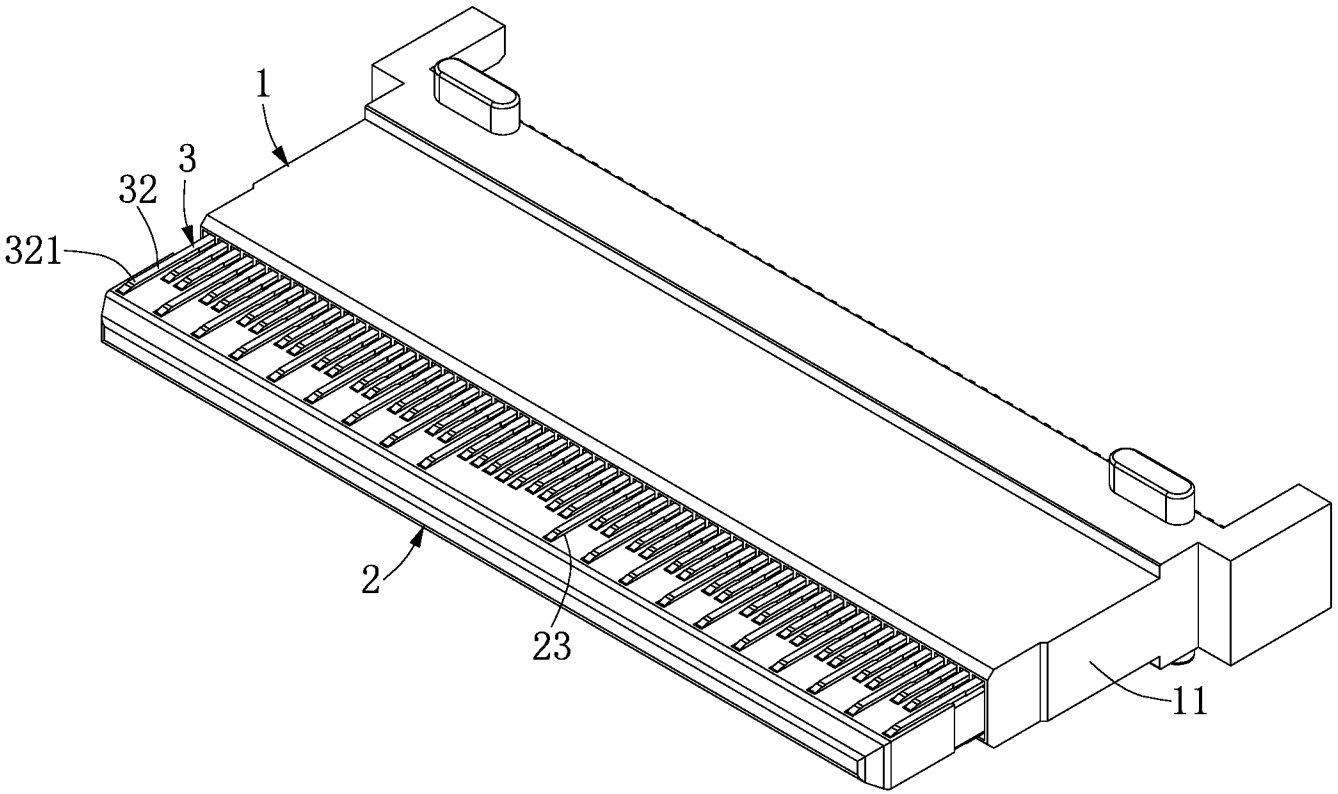
FIG. 5 is a perspective view illustrating the high-speed connector according to the first embodiment of the present disclosure.
Figure 6:
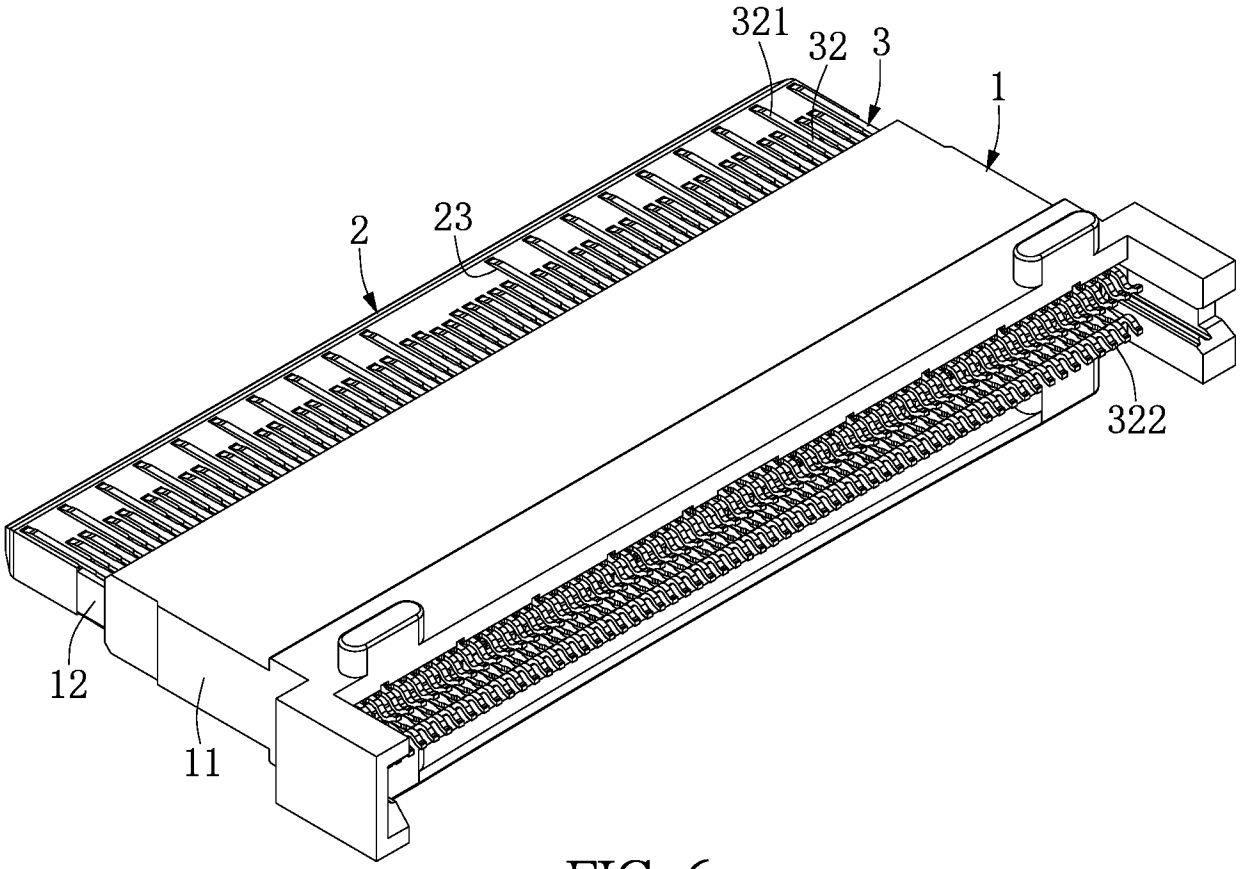
FIG. 6 is a perspective view illustrating the high-speed connector according to the first embodiment of the present disclosure seen from another point of view.
Figure 7:
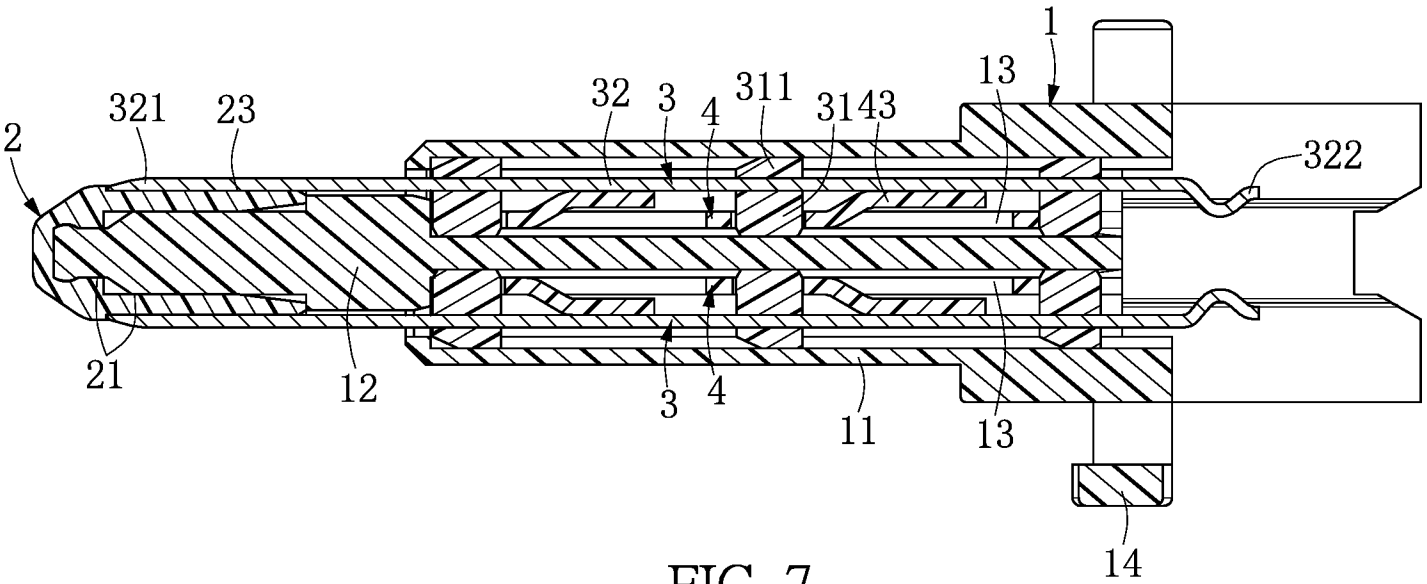
FIG. 7 is a sectional view illustrating the high-speed connector according to the first embodiment of the present disclosure.

The aforementioned illustrations and following detailed description are for exemplary purpose and are not limitations to the scope of the present disclosure. Other objectives and advantages related to the present disclosure will be illustrated in the following description and appended drawings.

The First Embodiment

Referring to FIGS. 1 to 7, the present disclosure provides a high-speed connector, and more particularly to a plug connector, which conforms to CFP standards. The plug connector includes an insulating body 1, an insulating cap 2, two terminal sets 3 and two shielding sheets 4.

The insulating body 1 is made of an insulating material, e.g. plastic. The insulating body 1 includes a body portion 11 and a tongue plate 12. The body portion 11 is hollow. The tongue plate 12 is disposed inside the body portion 11. The tongue plate 12 divides the interior of the body portion 11 into two accommodating spaces 13. The two accommodating spaces 13 are respectively located above and below the tongue plate 12. The front and rear end of the accommodating spaces 13 are open. The front end of the tongue plate 12 protrudes from that of the body portion 11.

The insulating body 1 includes an elastic rib member 14 at the bottom rear portion thereof. The elastic rib member 14 is in U-shape and extends towards both sides of the insulating body. The elastic rib member 14 serves as a limiting part, providing a push force when the high-speed connector is pulled so as to facilitate the withdrawal of the high-speed connector.

The insulating cap 2 is an elongated hollow body and includes a receiving hole 21 formed therein. The receiving hole 21 extends along a longitudinal direction of the insulating cap 2. The rear end of the insulating cap 2 has an opening. The receiving hole 2 includes a plurality of abutting sheets 22, and the front end of the tongue plate 12 of the insulating body 1 includes a plurality of indentations 15 corresponding to the plurality of abutting sheets 22. The receiving hole 21 of the insulating cap 2 is fitted around the front end of the tongue plate 12 of the insulating body 1 so that the insulating cap 2 is disposed at the front end of the tongue plate 12 of the insulating body 1.

The two terminal sets 3 each includes a terminal base 31 and a plurality of terminals 32. The terminal base 31 is made of an insulating material, e.g. plastic. The terminals 32 are made of metals of high conductivity or alloys thereof. The terminals 32 include signal terminals, power terminals and ground terminals and are disposed on the terminal base 31. The terminals can be made by performing an insert molding process and be disposed on the terminal base 31. The two ends (the front end and the rear end) of each of the terminals 32 respectively form a first end 321 and a second end 322. One side of the terminal base 31 includes a plurality of protrusions 311, which abut the inner surface of the insulating body 1 so that the terminal sets 3 can be fixedly disposed on the insulating body 1.

The two shielding sheets 4 are disposed on one side of each of the two terminal sets 3 respectively. That is to say, one shielding sheet 4 is disposed beneath the upper terminal set 3, and another shielding sheet 4 is disposed above the lower terminal set 3. The shielding sheet 4 is made of a metal material of high conductivity and is roughly in a rectangular shape. The shielding sheet 4 includes a plurality of insertion sheets 41 at the front end thereof. Each of the insertion sheets 41 has a barb member 42 at both sides thereof. A plurality of ground ports 43 is disposed on one side of each of the two shielding sheets 4. The ground ports 43 contact the ground terminals of the terminals 32 of the two terminal sets 3 so that the shielding sheets 4 form ground shielding with the ground terminals 43 of each of the two terminal sets 3.

The terminal base 31 of each of the terminal sets 3 includes a plurality of positioning members 312, and the shielding sheets 4 include a plurality of positioning holes 44 complementary to the plurality of positioning members 312 in a manner such that the terminal sets 3 and the shielding sheets 4 can fixedly engage each other.

Figure 8:
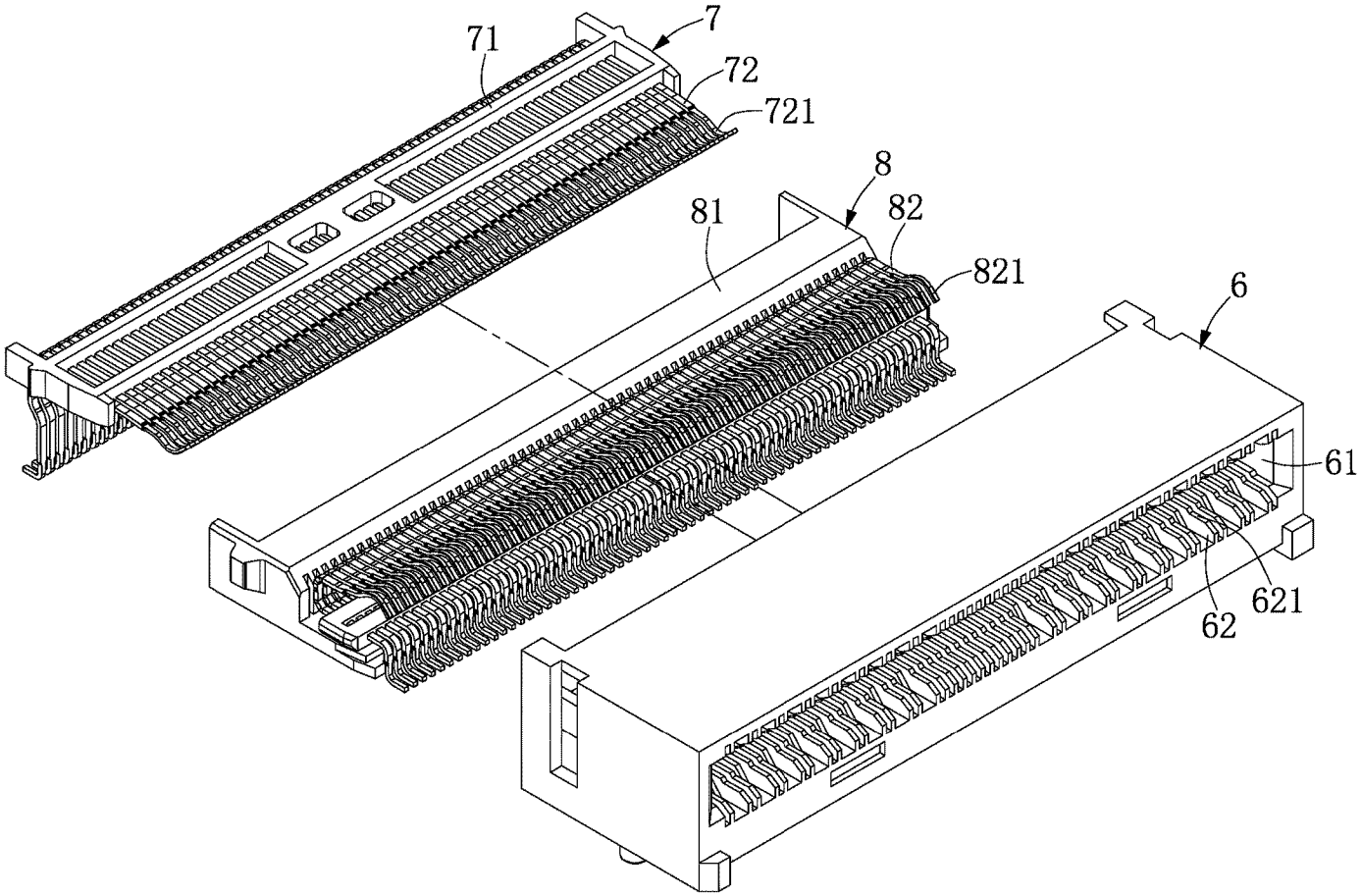
FIG. 8 is a perspective exploded view illustrating a socket connector according to a second embodiment of the present disclosure.
Figure 9:
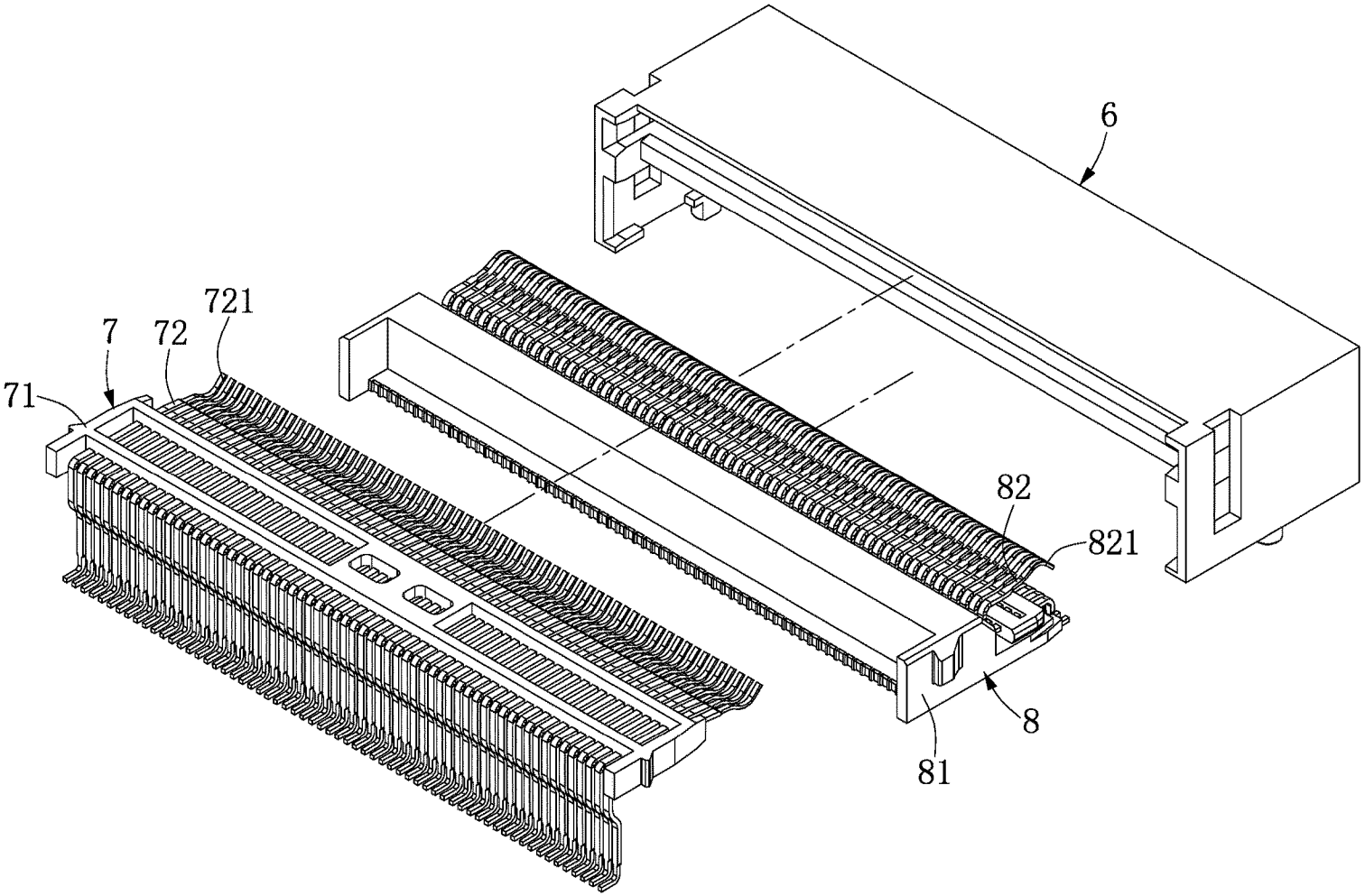
FIG. 9 is a perspective exploded view illustrating a socket connector according to the second embodiment of the present disclosure seen from another point of view.
Figure 10:
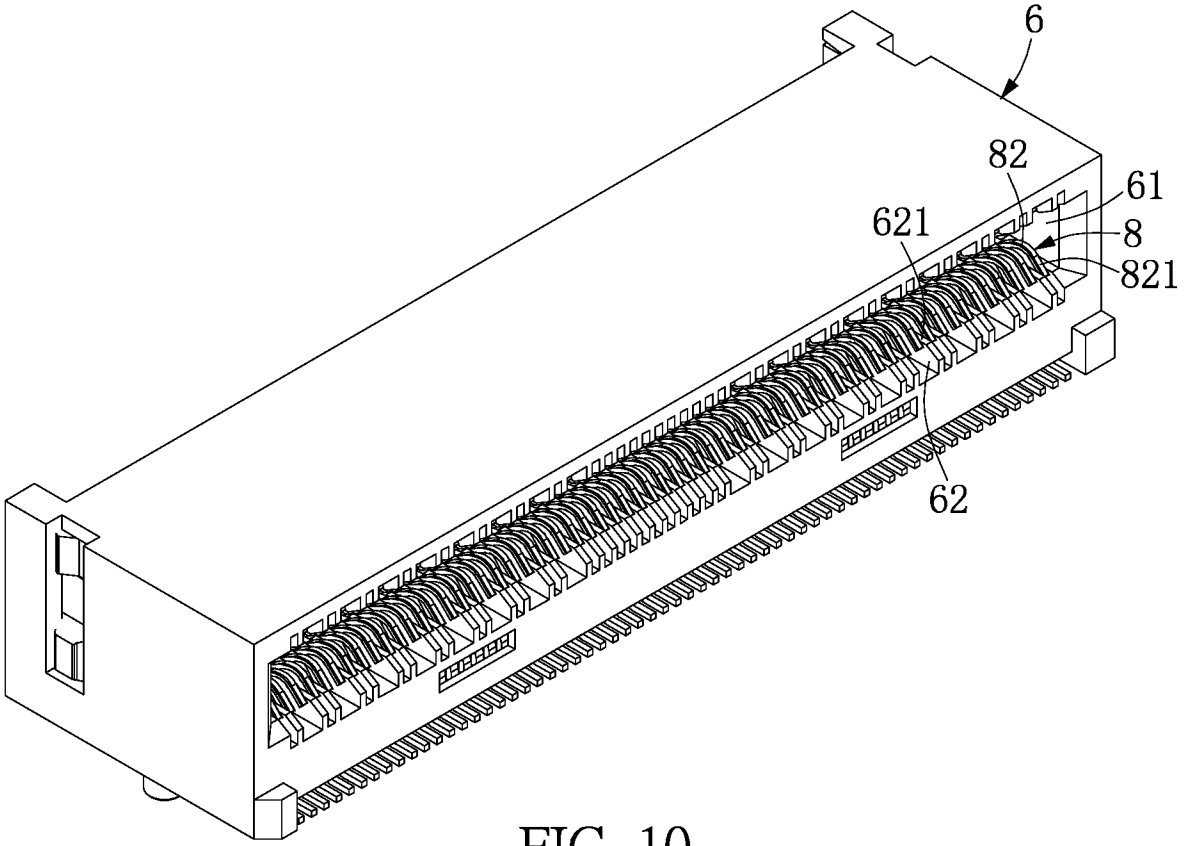
FIG. 10 is a perspective view illustrating the socket connector according to the second embodiment of the present disclosure.
Figure 11:
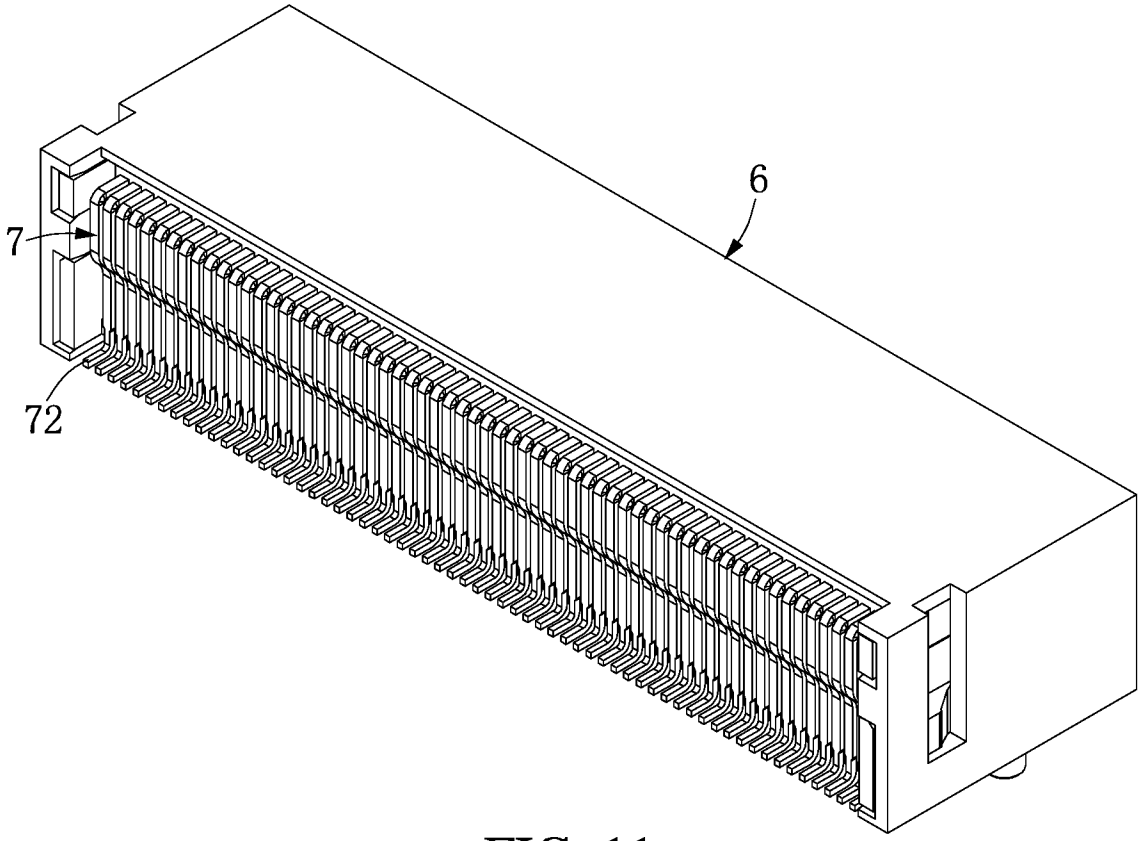
FIG. 11 is a perspective view illustrating the socket connector according to the second embodiment of the present disclosure seen from another point of view.
Figure 12:
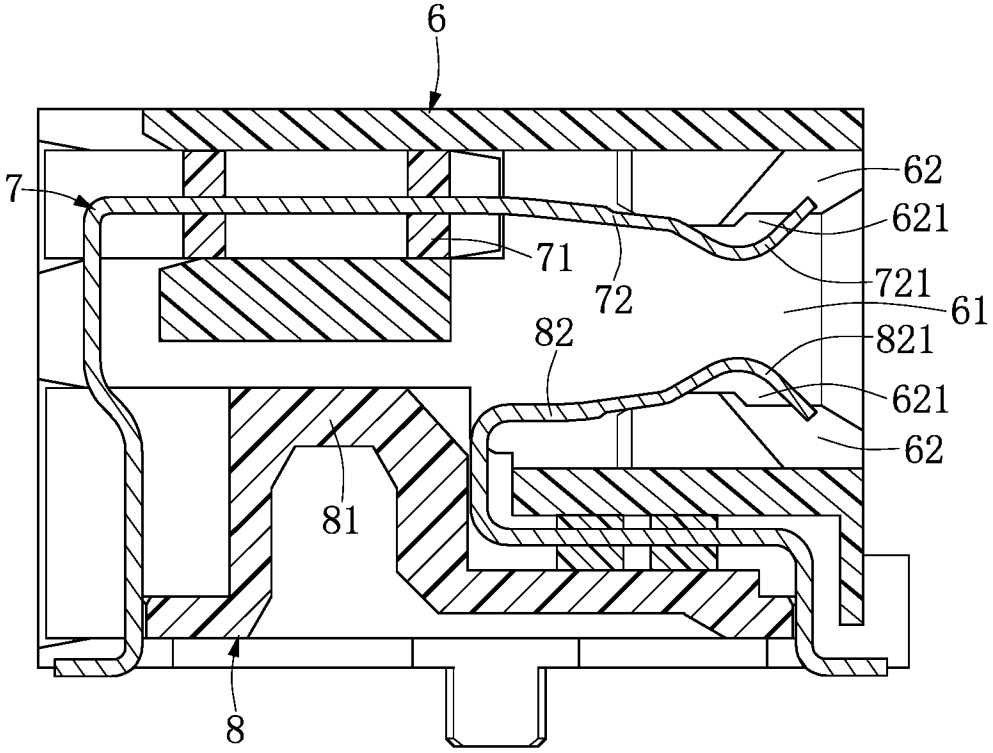
FIG. 12 is a sectional view illustrating the socket connector according to the second embodiment of the present disclosure.

The two shielding sheets 4 and the two terminal sets 3 are inserted into the two accommodating spaces 13 of the insulating body 1 so that the first end 321 of each terminal 32 protrudes from the front end of the body portion 11 of the body portion 11 and extends into the terminal grooves 23 situated on both sides of the insulating cap 2. In this way, when the high-speed connector of the present disclosure is connected to socket connector, the first end 321 of each terminal 32 contacts the first contact end 721 and the second contact end 821 (as shown in FIG. 8) and forms an electrical connection therewith. The second end 322 of each terminal 32 is exposed at the rear end of the body portion 11 for being connected to other electric devices. The insertion sheets 41 of the two shielding sheets 4 can be inserted into the insulating body 1, and the barb members 42 will be inserted into the insulating body 1 in a manner such that the shielding sheets 4 and the insulating body 1 are fixedly joined together.

In summary, the present disclosure includes two shielding sheets 4, each of which is disposed on one side of the terminal set 3, and a plurality of ground ports 43 is disposed on one side of each shielding sheet 4. The plurality of ground ports 43 contact the ground terminals of the terminals 32 of the two terminal sets 3 so that the two shielding sheets 4 form ground shielding with the two terminal sets 3. In this way, the high-speed connector of the present disclosure provides higher shielding capability, thus achieving cross-talk reduction and high speed transmission.

The Second Embodiment

With reference to FIGS. 8 to 12, the present disclosure further provides a socket connector including an insulating base 6, a first socket-terminal set 7 and a second socket-terminal set 8.

The insulating base 6 is made of an insulating material, e.g. plastic. The insulating base 6 is a hollow body and includes an insertion groove 61. A plurality of separators 62 is disposed on two opposite sides (the top surface and the bottom surface) of the insertion groove 61. The separators 62 are spaced apart from each other.

The first socket-terminal set 7 includes a first terminal base 71 and a plurality of first socket terminals 72. The first terminal base 71 is made of an insulating material, e.g. plastic. The plurality of first socket terminals 72 is made of a metal of high conductivity or an alloy thereof. The plurality of first socket terminals 72 includes signal terminals, power terminals and ground terminals, etc. The plurality of first socket terminals 72 is disposed on the first terminal base 71.

The second socket-terminal set 8 includes a second terminal base 81 and a plurality of second socket terminals 82. The second terminal base 81 is made of an insulating material, e.g. plastic. The plurality of second socket terminals 82 is made of a metal of high conductivity or an alloy thereof. The plurality of second socket terminals 82 includes signal terminals, power terminals and ground terminals, etc. The plurality of second socket terminals 82 is disposed on the second terminal base 81.

The first socket-terminal set 7 and the second socket-terminal set 8 are installed inside the insulating base 6. The plurality of first socket terminals 72 each includes a first contact end 721, and the plurality of second socket terminals 82 each includes a second contact end 821. The first contact end 721 of each of the first socket terminals 72 and the second contact end 821 of each of the second socket terminals 82 are situated in the insertion groove 61 of the insulating base 6, forming two vertically adjacent rows and being accommodated between the separators 62.

The separators 62 serve to divide and limit movements of the plurality of first socket terminals 72 and the second socket terminals 82. At least some of the separators 62 include a space portion 621, through which the first contact ends 721 of two adjacent first socket terminals 72 and the second contact ends 821 of two adjacent second socket terminals 82 can change the coupling effect, thereby lowering capacitance, increasing the inductance, and achieving high-speed transmission.

Figure 13:
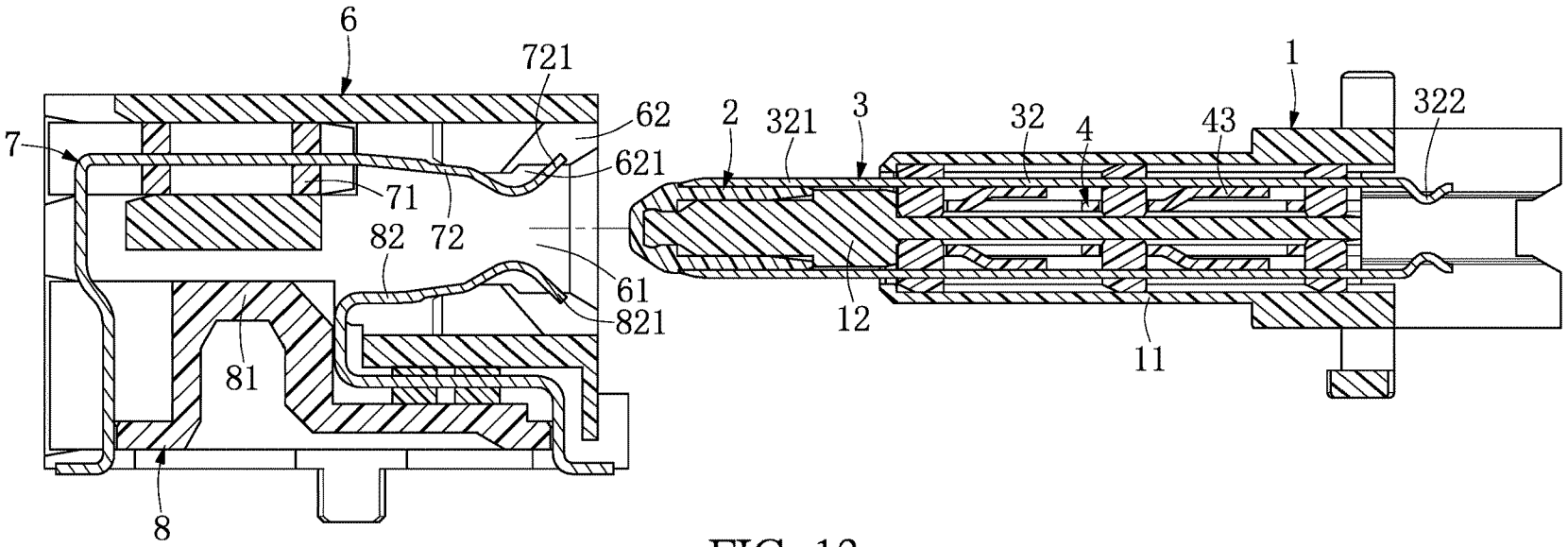
FIG. 13 is a sectional view illustrating a connector assembly according to the embodiment of the present disclosure.

With reference to FIG. 13, the high-speed connector and the socket connector can engage each other to form a connector assembly. When the high-speed connector and the socket connector engage each other, the front end of the high-speed connector can be inserted into the insertion groove 61 of the insulating base 6, in which the first end 321 of each terminal 32 contacts and forms an electrical connection with the first contact end 721 of the plurality of first socket terminals 72 and the second contact end 821 of the plurality of second socket terminals 82.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A high-speed electrical connector, comprising:

an insulating body including a body portion and a tongue plate, the body portion being hollow, the tongue plate being disposed in the body portion and dividing the interior of the body portion into two accommodating spaces, and the front end of the tongue plate protruding from that of the body portion;

an insulating cap including a receiving hole formed therein, the receiving hole extending along a longitudinal direction of the insulating cap, the rear end of the insulating cap having an opening, the insulating cap being fitted around the front end of the tongue plate of the insulating body, and the insulating cap having a plurality of terminal grooves on both sides thereof, and two terminal sets, each of which includes a terminal base and a plurality of terminals, the plurality of terminals including a plurality of ground terminals and being disposed on the terminal base, and each of the plurality of terminals having a first end and a second end respectively formed on either end thereof, and two shielding sheets disposed on one side of each of the two terminal sets respectively, a plurality of ground ports being disposed on one side of each of the two shielding sheets, in which the plurality of ground ports contacts the plurality of ground terminals of the plurality of terminals of each of the terminal sets so that the two shielding sheets form ground shielding with the ground terminals of each of the two terminal sets, wherein the two shielding sheets and the two terminal sets are inserted into the two accommodating spaces of the insulating body respectively such that the first end of the plurality of terminals protrudes from the front end of the body portion of the insulating body and extends into the terminal grooves on both sides of the insulating cap, and the second end of the plurality of terminals are exposed at the rear end of the body portion of the insulating body.

2. The high-speed electrical connector according to claim 1, wherein the insulating body includes an elastic rib member at the bottom rear portion thereof, the elastic rib member being in U-shape and extending towards both sides of the insulating body.

3. The high-speed electrical connector according to claim 1, wherein the receiving hole includes a plurality of abutting sheets, and the front end of the tongue plate of the insulating body includes a plurality of indentations corresponding to the plurality of abutting sheets.

4. The high-speed electrical connector according to claim 1, wherein each shielding sheet includes a plurality of insertion sheets at the front end thereof, both sides of the insertion sheets having a barb member so that when the two shielding sheets are inserted into the insulating body, the barb members are fitted in the insulating body.

5. The high-speed electrical connector according to claim 1, wherein one side of the terminal base has a plurality of protrusions, the plurality of protrusions abutting the inner surface of the insulating body.

6. The high-speed electrical connector according to claim 1, wherein the terminal base includes a plurality of positioning members, and the shielding sheets include a plurality of positioning holes complementary to the plurality of positioning members.

7. An electrical connector assembly, comprising:

the high-speed electrical connector as claimed in claim 1, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

8. The electrical connector assembly according to claim 7, wherein each of the plurality of first socket terminals and each of the plurality of second socket terminals include a signal terminal, the separators having the space portion being located between two adjacent signal terminals.

9. An electrical connector assembly, comprising:

the high-speed electrical connector as claimed in claim 2, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

10. The electrical connector assembly according to claim 9, wherein each of the plurality of first socket terminals and each of the plurality of second socket terminals include a signal terminal, the separators having the space portion being located between two adjacent signal terminals.

11. An electrical connector assembly, comprising:

the high-speed electrical connector as claimed in claim 3, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

12. The electrical connector assembly according to claim 11, wherein each of the plurality of first socket terminals and each of the plurality of second socket terminals include a signal terminal, the separators having the space portion being located between two adjacent signal terminals.

13. An electrical connector assembly, comprising:

the high-speed electrical connector as claimed in claim 4, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

14. The electrical connector assembly according to claim 13, wherein each of the plurality of first socket terminals and each of the plurality of second socket terminals include a signal terminal, the separators having the space portion being located between two adjacent signal terminals.

15. An electrical connector assembly, comprising:

the high-speed electrical connector as claimed in claim 5, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

16. The electrical connector assembly according to claim 15, wherein each of the plurality of first socket terminals and each of the plurality of second socket terminals include a signal terminal, the separators having the space portion being located between two adjacent signal terminals.

17. An electrical connector assembly, comprising:

the high-speed electrical connector as claimed in claim 6, the high-speed electrical connector being a plug connector;

a socket connector, including an insulating base, a first socket-terminal set, and a second socket-terminal set, wherein the insulating base includes an insertion groove, a plurality of separators being disposed on two opposite sides of the insertion groove, the plurality of separators being spaced apart from each other, in which the first socket-terminal set includes a first terminal base and a plurality of first socket terminals disposed on the first terminal base, and the second socket-terminal set includes a second terminal base and a plurality of second socket terminals disposed on the second terminal base, the first socket-terminal set and the second socket-terminal set being installed in the insulating base, wherein each of the plurality of first socket terminals has a first contact end, and each of the plurality of second socket terminals has a second contact end, the first contact end of each of the first socket terminals and the second contact end of each of the second socket terminals being situated in the insertion groove of the insulating base, wherein the first contact end of each of the first socket terminals and the second contact end of each of the second socket terminals form two vertically adjacent rows and are accommodated between the separators, and wherein at least some of the separators include a space portion, through which the first contact ends of two adjacent first socket terminals and the second contact ends of two adjacent second socket terminals change the coupling effect, lowering capacitance and increasing the inductance, wherein the front end of the high-speed connector is inserted into the insertion groove of the insulating base of the socket connector in a manner such that the first end of each of the terminals contacts and form an electrical connection with the first contact end of each of the first socket terminals and the second contact end of each of the second socket terminals.

18. The electrical connector assembly according to claim 17, wherein each of the plurality of first socket terminals and each of the plurality of second socket terminals include a signal terminal, the separators having the space portion being located between two adjacent signal terminals.

* * * * *